US010183319B2

(12) United States Patent
Lutterbach et al.

(10) Patent No.: US 10,183,319 B2
(45) Date of Patent: Jan. 22, 2019

(54) DRAWING DIE ARRANGEMENT AND MATERIAL GUIDE TO THE ARRANGEMENT, AHEAD OF A DRAWING DIE ARRANGEMENT, AS WELL AS DRAWING METHOD(S)

(71) Applicant: SMS group GmbH, Duesseldorf (DE)

(72) Inventors: Patrick Lutterbach, Eupen (BE); Enver Yurdusever, Hueckelhoven (DE); Ali Zafari, Aachen (DE); Thomas Cmiel, Aachen (DE)

(73) Assignee: SMS group GmbH, Duesseldorf (DE)

( * ) Notice: Subject to any disclaimer, the term of this patent is extended or adjusted under 35 U.S.C. 154(b) by 0 days.

(21) Appl. No.: 15/468,357

(22) Filed: Mar. 24, 2017

(65) Prior Publication Data

US 2017/0189950 A1 Jul. 6, 2017

Related U.S. Application Data

(62) Division of application No. 14/263,314, filed on Apr. 28, 2014, now Pat. No. 9,636,729.
(Continued)

(30) Foreign Application Priority Data

May 16, 2013 (DE) ..... 10 2013 008 347

(51) Int. Cl.
*B21D 3/14* (2006.01)
*B21C 3/14* (2006.01)
(Continued)

(52) U.S. Cl.
CPC ..... *B21C 3/14* (2013.01); *B21C 1/00* (2013.01); *B21C 51/00* (2013.01)

(58) Field of Classification Search
CPC .. B21C 1/32; B21C 1/34; B21C 47/34; B21C 3/14; B21D 43/006; B23Q 3/005; B23Q 3/04; B23Q 3/10; B23Q 3/105
See application file for complete search history.

(56) References Cited

U.S. PATENT DOCUMENTS 4,196,607 A 4/1980 Youtsey et al.
8,627,703 B2 1/2014 Corder
(Continued)

FOREIGN PATENT DOCUMENTS

DE 29 12 996 A1 10/1979
DE 40 19 865 A1 1/1992
(Continued)

OTHER PUBLICATIONS

German Office Action in DE 10 2013 008 347.8 dated Mar. 4, 2014 with English translation of relevant parts.
(Continued)

*Primary Examiner* — Debra Sullivan
(74) *Attorney, Agent, or Firm* — Collard & Roe, P.C.

(57) ABSTRACT

The invention relates to a drawing die arrangement having a drawing tool that acts on an elongated workpiece, and having a drawing tool support on which the drawing tool is mounted, counteracting the drawing tool, in which support a measurement device that measures the mass distribution of the workpiece material is disposed on the drawing tool, wherein a coupling medium circulated between the measurement device and the drawing tool is provided. Furthermore, the invention relates to a workpiece guide and to a drawing system.

1 Claim, 6 Drawing Sheets

Related U.S. Application Data

(60) Provisional application No. 61/818,535, filed on May 2, 2013.

(51) Int. Cl.
*B21C 1/00* (2006.01)
*B21C 51/00* (2006.01)

(56) References Cited

U.S. PATENT DOCUMENTS

| | | | |
|---|---|---|---|
| 2010/0064750 | A1 | 3/2010 | Corder |
| 2013/0269406 | A1 | 10/2013 | Corder |

FOREIGN PATENT DOCUMENTS

| | | | |
|---|---|---|---|
| DE | 10 2009 039 873 | A1 | 4/2010 |
| EP | 1 033 554 | B1 | 10/2001 |

OTHER PUBLICATIONS

Austrian Office Action in AT A 319/2014-1 dated Jan. 26, 2017 with English translation of relevant parts.

DRAWING DIE ARRANGEMENT AND MATERIAL GUIDE TO THE ARRANGEMENT, AHEAD OF A DRAWING DIE ARRANGEMENT, AS WELL AS DRAWING METHOD(S)

CROSS REFERENCE TO RELATED APPLICATIONS

This application is a divisional of and Applicant claims priority under 35 U.S.C. §§ 120 and 121 of U.S. application Ser. No. 14/263,314 filed on Apr. 28, 2014, which claims priority under 35 U.S.C. § 119(e) of U.S. Provisional Patent Application Ser. No. 61/818,535 filed May 2, 2013 and under 35 U.S.C. § 119 of German Application No. 10 2013 008 347.8 filed May 16, 2013, the disclosures of which are incorporated by reference. A certified copy of priority German Application No. 10 2013 008 347.8 is contained in parent U.S. application Ser. No. 14/263,314.

BACKGROUND OF THE INVENTION

1. Field of the Invention

The invention relates to a drawing die arrangement having a drawing tool that acts on an elongated workpiece, and having a drawing tool support on which the drawing tool is mounted, counteracting the drawing tool, in which support a measurement device that measures the mass distribution of the workpiece material is disposed on the drawing tool. Also, the invention relates to a workpiece guide for placement ahead of a drawing die arrangement, as well as to a drawing system having a drawing machine that has a drawing die arrangement through which the drawing machine draws a workpiece, and having a workpiece guide disposed ahead of the drawing die arrangement in the drawing direction.

2. Description of the Related Art

Such a drawing die arrangement is known from DE 10 2009 039 873 A1, whereby here, a drawing tool referred to as a drawing ring serves for shaping the elongated workpiece that is to be formed in the drawing method, in each instance. In particular, it is known from DE 10 2009 039 873 A1 to provide a material guide ahead of the drawing ring, in each instance, in the drawing direction, by way of which guide the workpiece to be drawn, in each instance, is passed to the drawing ring.

In the production of seamless tubes, using the drawing method, a great technical challenge lies in processing the workpieces to be drawn, which are configured in the form of hollow bodies, in this connection, during the drawing method, in such a manner that the finished tube or the finished drawn product has the most uniform mass distribution possible of the workpiece material, over the cross-section, or that the finished drawn product has the most uniform thickness expanse possible over the cross-section. For this purpose, it is proposed in DE 10 2009 039 873 A1 to configure a workpiece guide that is disposed ahead of the drawing ring in the drawing direction—by way of which the workpiece, in each instance, is passed to the drawing ring—so as to be displaceable relative to the drawing direction.

By means of suitable displacement of the workpiece guide and thereby also ultimately of the feed direction, in which the workpiece, in each instance, is passed to the drawing ring, as uniform a mass distribution as possible can be made available in the drawn product to be produced by means of the drawing method, in that irregularities or uneven wall thicknesses or eccentricities of the workpiece to be formed or reshaped, for example, which can have an influence on the quality of the formed workpiece, are evened out by means of suitable displacement of the workpiece guide. From DE 10 2009 039 873 A1, it is known, in this connection, to determine the displacement of the workpiece guide, in each instance, that is required for the production of a drawn product having the most uniform mass distribution possible, in cross-section, in each instance, in that the mass distribution of the workpiece material is measured in cross-section, and the workpiece guide is displaced in accordance with the measured mass distribution.

SUMMARY OF THE INVENTION

It is the task of the present invention to improve the quality of the workpiece formed in the manner described above.

In this connection, the invention proceeds from the basic recognition that for this purpose, measures must be taken at the drawing tool support, for which purpose, however, it might be necessary to create the required space. Proceeding from this basic recognition, drawing die arrangements, workpiece guides and drawing systems having the characteristics of the independent claims are proposed as concrete solutions. Further advantageous embodiments are found in the dependent claims and the following description.

Thus, in the case of a drawing die arrangement of the stated type, which is characterized in that a coupling medium circulated between the measurement device and the drawing tool is provided, significantly better or more precise measurement of the mass distribution of the workpiece material by means of the measurement device can be made possible as a result of the coupling medium that is provided, whereby it can be advantageously ensured, by means of providing the circulation for guiding the coupling medium, that coupling medium is constantly present between the measurement device and the drawing tool. By means of the great measurement accuracy in the measurement of the mass distribution that is advantageously made available, the displacement of the workpiece guide that is required for equalizing irregularities in the workpiece to be formed or to be drawn can be determined very precisely on the basis of the precisely measured mass distribution. Viewed in total, the quality of the workpiece formed using the drawing die arrangement can therefore be significantly improved as a result.

Preferably, a circulation channel for the coupling medium is provided in the drawing tool support, in which channel the coupling medium can be accommodated to implement securely guided circulation, whereby a pump can be provided to make the circulation of the coupling medium available.

In order to be able to undertake a precise or better measurement of the mass distribution of the workpiece, a coupling medium that has a lower viscosity than a drawing oil used for drawing the workpiece can be provided between the measurement device and the drawing tool, in the case of a drawing die arrangement having a drawing tool that acts on an elongated workpiece and having a drawing tool support on which the drawing tool is mounted, counteracting the drawing tool or the workpiece, in which support a measurement device that measures the mass distribution of the workpiece material is disposed on the drawing tool.

By means of providing a coupling medium having a lower viscosity than the drawing oil used for drawing the workpiece, the precision or the quality of the measurement for measuring the mass distribution of the workpiece material can be significantly improved. A drawing oil used for drawing the workpiece, in contrast, is suitable as a coupling medium for a measurement device only in very restricted manner, because of its higher viscosity, particularly if the distance between measurement device and drawing tool is chosen to be as small as possible, for reasons of great measurement accuracy. This is all the more true if the coupling medium is supposed to be circulated and also reach into the narrow gap between measurement device and drawing tool.

A precise or better measurement of the mass distribution of the workpiece material can also be implemented with a drawing die arrangement having a drawing tool that acts on an elongated workpiece and having a drawing tool support on which the drawing tool is mounted, counteracting the drawing tool, in which a measurement device that measures the mass distribution of the workpiece material is disposed on the drawing tool, which arrangement is characterized in that an accommodation opening for the measurement device is provided in the drawing tool support. By means of providing an accommodation opening, a better measurement can be implemented in that the distance between the measurement device and the inner wall of the drawing tool can be freely selected. In this regard, the distance can be adapted to the running times of a measurement signal or similar geometrical general conditions, in order to obtain optimal measurement results in this manner.

Preferably, the drawing tool support can comprise a drawing ring that lies against the drawing tool, and whereby the accommodation opening is provided on the drawing ring. By means of providing the accommodation opening on a drawing ring that lies against the drawing tool, the measurement device can be positioned in the immediate vicinity of the drawing tool, in order to achieve a precise measurement in advantageous manner.

Cumulatively or alternatively, a depression or an accommodation opening can also be provided on the drawing tool, in order to accommodate an end section of a measurement device, which might be accommodated in an accommodation opening of the drawing ring, in the drawing tool, thereby making it possible to implement a very small distance between the inner wall of the drawing tool and the measurement device, accompanied by achieving a very precise measurement.

Preferably, the accommodation opening can radially penetrate the drawing tool support, the drawing ring or the drawing tool, and a seal can be disposed between the measurement device and the drawing tool support, the drawing ring or the drawing tool. Providing the seal brings with it the advantage that exiting of the coupling medium can be effectively avoided, while the radially oriented accommodation opening can be made available in simple and operationally reliable manner.

To avoid exiting of the coupling medium, a seal can preferably be disposed also between the drawing tool support and the drawing tool.

Preferably, the drawing tool support and the drawing tool can be connected with one another by means of a press connection and/or a shrink connection. In this manner, it might be possible to advantageously do without the use of a separate seal in order to produce tightness, if the tightness can already be made available by means of the press connection and/or the shrink connection.

In order to be able to implement a better or more precise measurement of the mass distribution of the workpiece material, a drawing die arrangement having a drawing tool that acts on an elongated workpiece and having a drawing tool support on which the drawing tool is mounted, counteracting the drawing tool, in which a measurement device that measures the mass distribution of the workpiece material is disposed on the drawing tool, can be provided, which arrangement is characterized in that a spacer that defines a space for coupling medium is provided between the measurement device and the drawing tool. If applicable, this space defined by the spacer merely represents a gap.

By means of providing the spacer that defines a space for the coupling medium, a very precise and very problem-free measurement of the mass distribution of the workpiece material by means of the measurement device can be implemented in that very defined coupling of the measurement device to the coupling medium is possible by providing the space for the coupling medium. Also, the space for the coupling medium allows a defined flow, if, as was already explained above, the coupling medium is provided in circulation. The spacer can preferably comprise a spacer ring or a partial spacer ring.

In particularly practical manner, the space for the coupling medium can be machined out of the measurement device or the drawing tool, and the spacer can be formed by a remaining projection of the measurement device, whereby the spacer is particularly preferably configured in one piece with the measurement device. A spacer configured in one piece with the measurement device can advantageously be produced, in simple and practical manner, by means of a milling or chip-cutting method and/or by means of erosion of a hard metal, for example. The projection can particularly be situated on a test head of the measurement device.

A very precise measurement of the mass distribution of the workpiece material can also be implemented with a drawing die arrangement having a drawing tool that acts on an elongated workpiece and having a drawing tool support on which the drawing tool is mounted, counteracting the drawing tool, in which a measurement device that measures the mass distribution of the workpiece material is disposed on the drawing tool, which arrangement is characterized in that a bracing apparatus for the measurement device, which apparatus acts in the direction toward the drawing tool, is provided on the drawing tool support.

By means of the bracing apparatus, very precise positioning of the measurement device is possible, of course accompanied by very precise measurement, in which error influences as the result of undesirable positioning of the measurement device are effectively suppressed. The bracing apparatus is provided, in advantageous manner, on the drawing tool support and not on the drawing tool, because providing a bracing apparatus on the drawing tool would practically be possible only in very complicated manner, as a result of the very hard material that must be provided for the drawing tool.

To achieve very effective defined bracing of the measurement device, the bracing apparatus preferably comprises a three-point bracing unit.

A very precise measurement of the mass distribution of the workpiece material can also be implemented by means of a drawing die arrangement having a drawing tool that acts on an elongated workpiece and having a drawing tool support on which the drawing tool is mounted, counteracting the drawing tool, in which a measurement device that measures the mass distribution of the workpiece material is disposed on the drawing tool, which arrangement is characterized in that the measurement device is directed at a region that lies behind the drawing and wall ironing area of the drawing die arrangement, in the drawing direction, and/or at a cylindrical region of the drawing tool or of a drawing mandrel.

It has been shown that in these regions, a very precise measurement of the mass distribution of the workpiece material is possible, which then in turn results in a corresponding quality of the formed workpiece.

In this connection, the measurement device is particularly preferably focused in the direction of the region that lies behind the drawing and wall ironing area of the drawing arrangement, in the drawing direction, or on the cylindrical region, in order to optimize the quality of the measurement.

In the case of a workpiece guide to be disposed ahead of a drawing die arrangement, whereby the workpiece guide comprises a workpiece contact surface, a rack, a displacement device for the workpiece contact surface disposed on the rack, and means for positioning the rack with reference to a drawing die arrangement or a drawing machine, the quality of the workpiece formed or reshaped by means of the drawing die arrangement can be improved in that the rack can be positioned with reference to the drawing die arrangement or the drawing machine, as explained below.

Thus, such positioning ability is not known from the straight drawing machine known from DE 10 2009 039 873 A1. There, the workpiece guide is attached to the apparatus that accommodates the drawing ring, in complex and technically complicated manner. This in turn has the result that because of the space for operation of a straight drawing machine, which is generally only available with restrictions, for economic reasons, structural measures on the drawing ring—whereby in this document, the term drawing ring refers to the tool for shaping the elongated workpiece to be formed in the drawing process, in each instance—or on the drawing ring accommodation, to optimize the quality of the formed workpiece, are generally only possible in greatly restricted manner. In contrast to this, a significant space saving can be made available in the region of the drawing die arrangement by providing the positionable rack—which can be positioned with reference to the drawing die arrangement or the drawing machine only for carrying out the drawing method, in each instance, or can be coupled with the drawing die arrangement or the drawing machine by simple positioning. This space saving advantageously allows making a comparatively large construction space available for the drawing die arrangement, so that suitable measures or remodeling of the drawing die arrangement can advantageously be implemented to improve the quality of the formed workpiece, as already explained above, although not conclusively.

Preferably, the displacement device comprises a linear guide for the workpiece contact surface. Very precise displacement in the direction predetermined by the linear guide is possible by means of a linear guide, without structural measures having to be undertaken too close to the drawing die arrangement. In particular, in this way a guide can be implemented by means of which the workpiece contact surface can be displaced with reference to or about a point of rotation or a central area, without the workpiece guide itself having to be structurally present in the region of this area, particularly axially with reference to an elongated workpiece that runs through the workpiece guide, so that sufficient space for a drawing die arrangement remains there.

In order to make non-movable positioning of the rack with reference to the drawing die arrangement or the drawing machine available, the positioning means can comprise fixation means, such as, for example, screws for anchoring in the floor or weld plates for a non-releasable connection with a drawing stand.

Particularly preferably, the positioning means comprise at least afoot and/or an attachment device. Also, the rack is preferably self-supporting, cumulatively or alternatively to this. By means of such positioning means or by providing a self-supporting rack, the workpiece guide can be configured, in structurally simple manner, as a separately positionable unit or total arrangement, which can be positioned as such, in advantageous manner, with reference to the drawing die arrangement or the drawing machine. A workpiece guide configured in this manner, as a separately positionable unit or total arrangement, also allows interaction with drawing die arrangements or drawing machines that are not yet provided with such a workpiece guide, in the manner of a module.

The quality of the formed workpiece can also be improved by means of a drawing system having a drawing machine, having an above drawing die arrangement through which the drawing machine draws a workpiece, and having a workpiece guide disposed ahead of the above workpiece guide, in the drawing direction, as already explained above.

It is understood that the characteristics of the solutions described above and in the claims can also be combined, if applicable, in order to be able to implement the advantages cumulatively, accordingly.

BRIEF DESCRIPTION OF THE DRAWINGS

Further advantages, goals, and properties of the present invention will be explained using the following description of exemplary embodiments, which are particularly also shown in the attached drawing. The drawing shows.

DETAILED DESCRIPTION OF PREFERRED EMBODIMENTS

Figure 1:
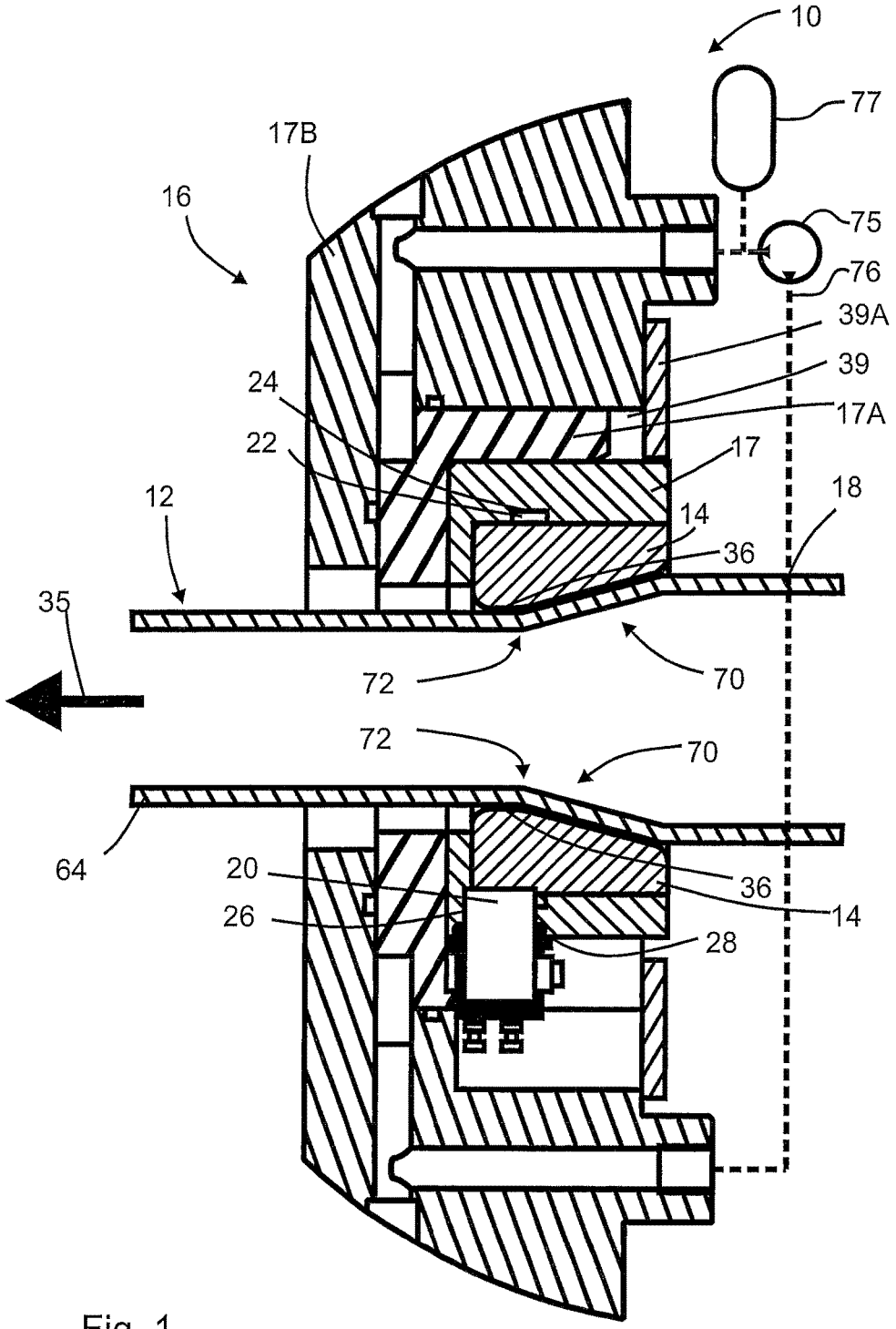
FIG. 1 a sectional representation of a drawing die arrangement.

The drawing die arrangement 10 shown in FIG. 1 comprises a drawing tool 14, which is provided for acting on an elongated workpiece 12. The drawing die arrangement 10 furthermore comprises a drawing tool support 16 on which the drawing tool 14 is mounted, counteracting the drawing tool 14, in which a measurement device 20 that measures the mass distribution of the workpiece material 18 is disposed on the drawing tool 14. The drawing tool support 16 is configured in multiple parts and comprises an adapter ring 17A, a drawing ring holder 17B in the form of a spherical cap, and a drawing ring 17 that lies against the drawing tool 14.

A coupling medium 22 that is circulated is provided between the measurement device 20 and the drawing tool 14, whereby a circulation channel 24 for the coupling medium 22 is provided in the drawing tool support 16, so that the coupling medium 22 can be circulated by means of the circulation channel 24 or moved in circulation by means of the circulation channel 24. It is understood that the circulation channel 24 of this exemplary embodiment is connected, in sufficiently known manner, with a pump 75 and with a coupling medium supply 77, by way of incoming and outgoing lines 76.

The measurement device 20 of this exemplary embodiment comprises an ultrasound sensor that is partially accommodated in an accommodation opening 26 provided in the drawing ring 17 of the drawing ring support 16. In other exemplary embodiments, other types of sensors, for example X-ray sensors, can also be used.

The accommodation opening 26 penetrates the drawing tool support 16 radially or in a radial direction, and a seal 28 is disposed between the measurement device 20 and the drawing tool support 16.

Figure 2A:
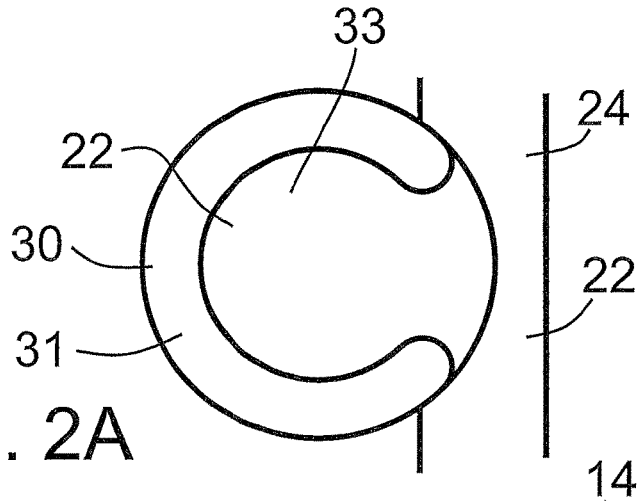
FIG. 2A the measurement device according to FIG. 2 in a schematic view from below.
Figure 2:
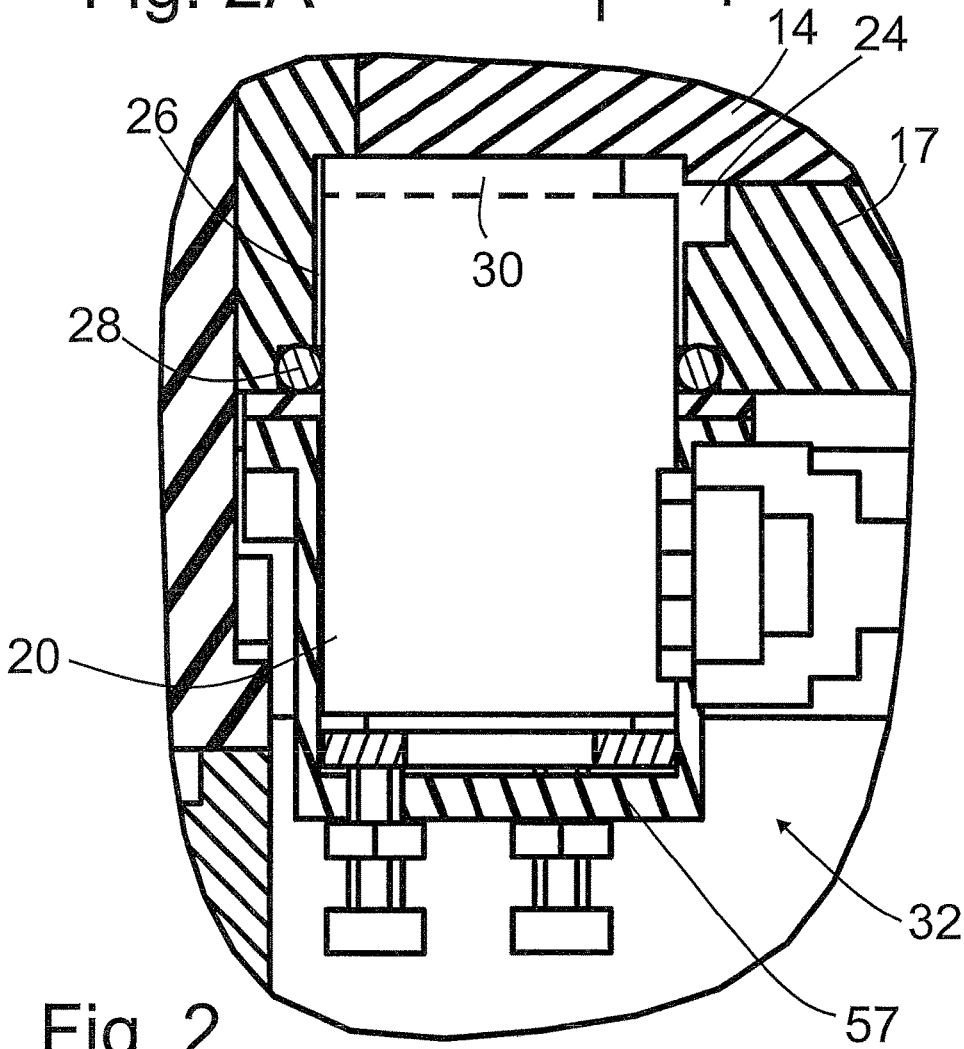
FIG. 2 an enlarged representation of a detail of FIG. 1, which particularly shows a measurement device of the drawing die arrangement.

It is not shown in FIG. 1 but can be derived from FIG. 2 that a spacer 30, which defines a space 33 for the coupling medium 22, is provided between the measurement device 20 and the drawing tool 14.

The space 33 for the coupling medium 22 is machined out of the measurement device 20, whereby the spacer 30 is formed by a remaining projection 31 of the measurement device 20. Accordingly, in the exemplary embodiment illustrated here, the spacer 30 is configured in one piece with the measurement device 20.

Figure 3:
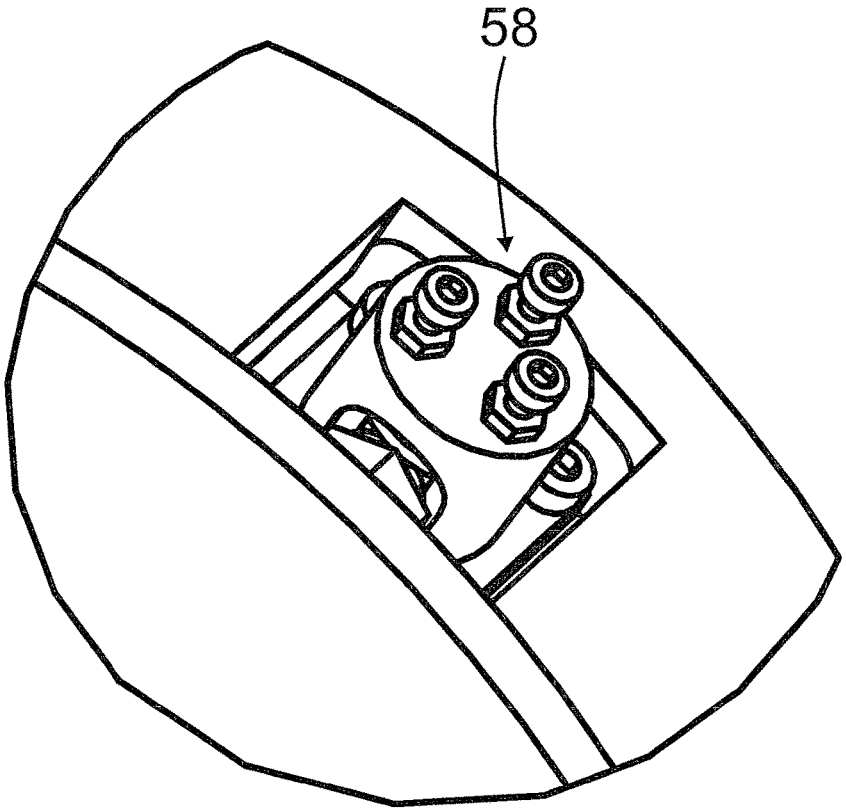
FIG. 3 a three-dimensional representation of the measurement device, in a perspective from which the configuration of the face region of the measurement device is evident in greater detail.
Figure 4:
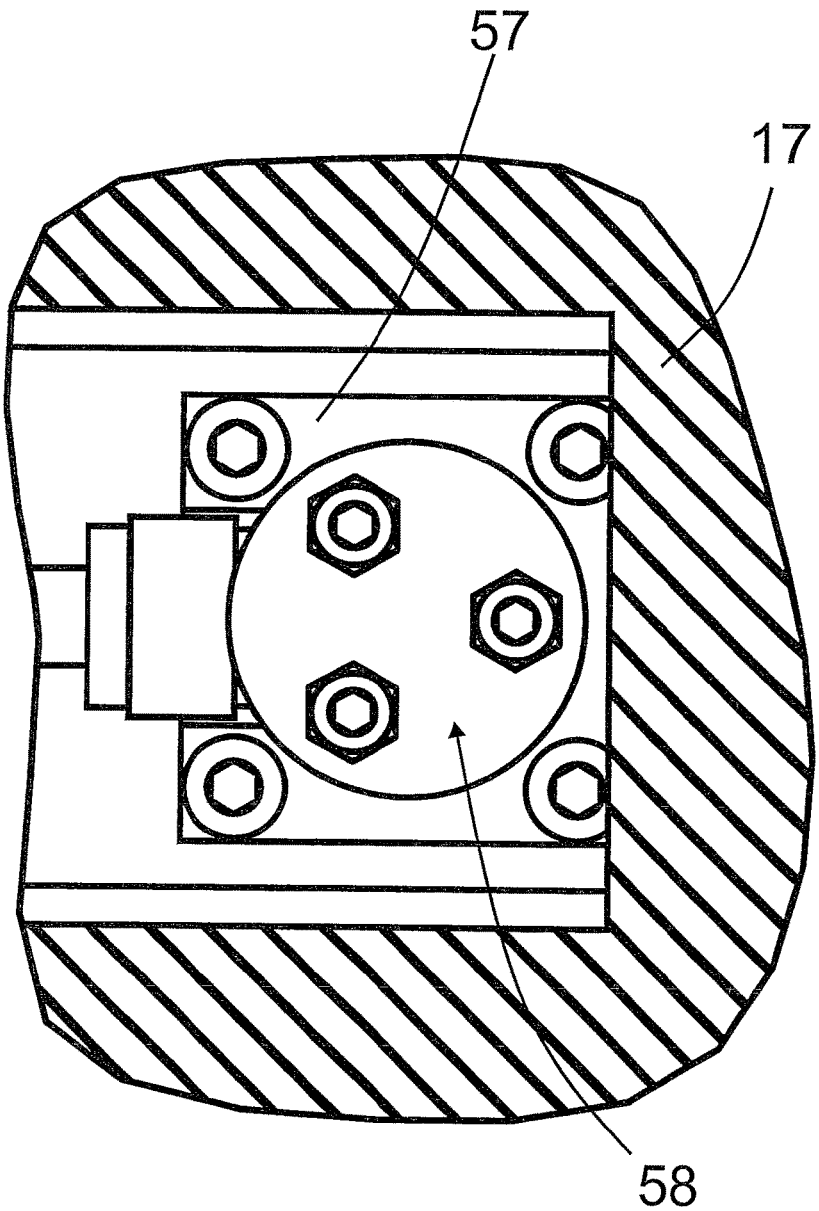
FIG. 4 a top view of the measurement device.

A bracing apparatus 32 for the measurement device 20, which acts in the direction toward the drawing tool 14, is provided on the drawing tool support 16 (see FIG. 2), whereby the bracing apparatus 32 comprises a U-shaped bracing element 57 and three-point bracing unit 58 (see FIG. 3), which has three screw connections, in each instance. The U-shaped bracing element 57 is screwed onto the drawing ring 17 by means of four screws (see FIG. 4).

As can be derived from FIG. 1, the measurement device 20 is particularly directed at a region that lies behind a drawing and wall ironing area of the drawing die arrangement 10, in the drawing direction 35, and is particularly also focused in the direction of this region.

FIG. 1 illustrates the situation for forming a tube 64 by means of drawing, with or without a mandrel, whereby a mandrel is not shown in the figures. The use of a mandrel is particularly advantageous in application cases in which a very uniform wall thickness stands in the foreground.

The forming procedure during tube drawing can be divided into two regions, namely the hollow drawing component and the drawing and wall ironing component, or the hollow drawing area 70 and the drawing and wall ironing area 72 (see FIG. 1). In the hollow drawing area 70, the workpiece 12 is reduced to the desired outside diameter. The drawing and wall ironing area 72 begins starting from the point from which the drawing tool 14 does not demonstrate any further narrowing in the drawing direction 35, and extends in the drawing direction 35 up to the point from which no further forming takes place any longer. The drawing tool 14 has a cylindrical region 36, whereby the drawing and wall ironing area 72 is defined by this region.

The drawing die arrangement 10 furthermore has a cable channel 39 covered by a cover 39A, to bring in a measurement line or a supply line for the measurement device 20 from outside of the drawing die arrangement 10. Likewise, the drawing tool support comprises further channels for coolants, which are known and therefore not numbered, whereby the division of the drawing tool support 16 essentially represents facilitation of production, in this regard.

Figure 6:
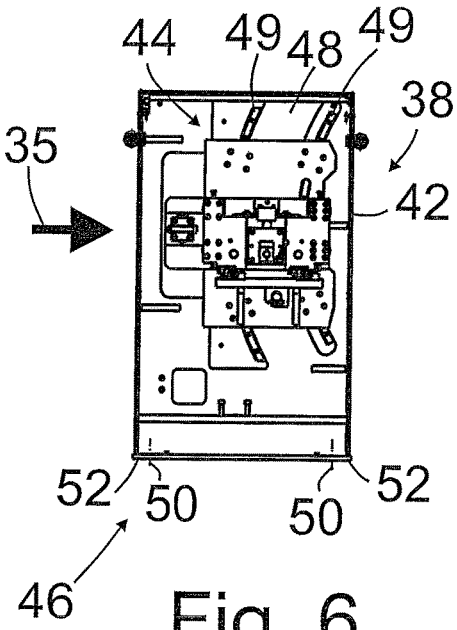
FIG. 6 a front view of the workpiece guide according to FIG. 5.
Figure 5:
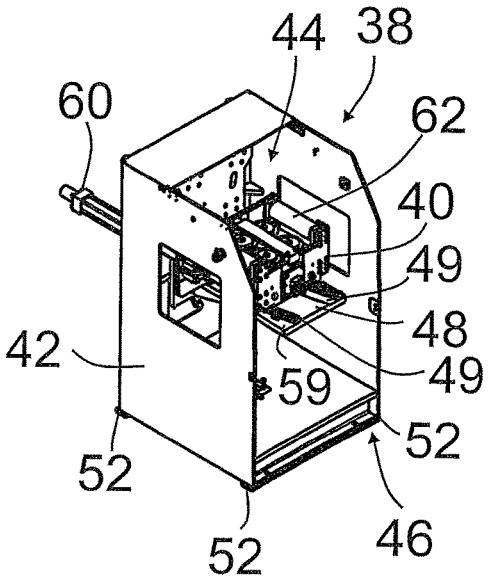
FIG. 5 a three-dimensional representation of a workpiece guide, with the front flap open.
Figure 7:
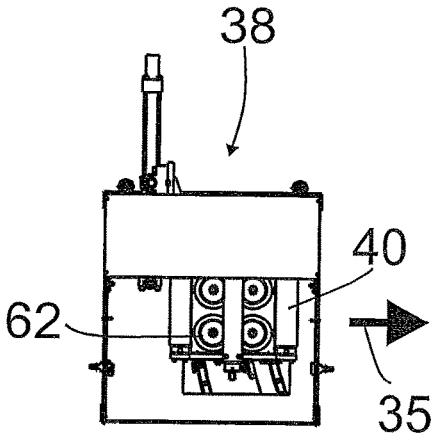
FIG. 7 a top view of the workpiece guide according to FIGS. 5 and 6.
Figure 10:
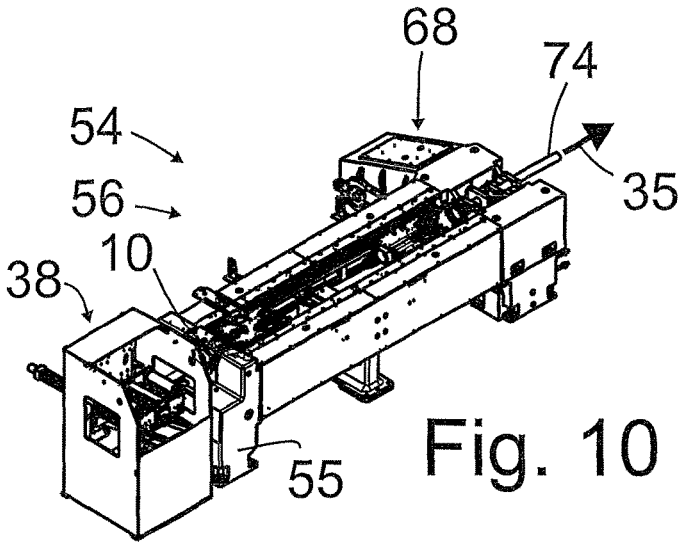
FIG. 10 a three-dimensional representation of the drawing system according to FIGS. 8 and 9.

The workpiece guide 38 shown in FIG. 5, which can be provided for placement ahead of a drawing die arrangement 10 (see FIG. 10), comprises a workpiece contact surface 40 having rolls 62 and guide tubes, rollers, and corresponding roller guides or roller accommodations not illustrated in any detail, a rack 42, a displacement device 44 for the workpiece contact surface 40, disposed on the rack 42, and means 46 for positioning the rack 42 with reference to the drawing die arrangement 10 or a drawing machine 56 (see FIG. 10). The positioning means 46 comprise schematically represented fixation means 50, such as screws, for example, for anchoring in the floor, and four feet 52. The rack 42 is configured in self-supporting manner or is self-supporting. The displacement device 44 comprises a first and a second linear guide 48, whereby each linear guide has two guide rails 49 for the workpiece contact surface 40, in each instance. The first linear guide 48 illustrated in FIG. 6 extends in the shape of an arc, to implement pivoting ability of the workpiece contact surface 40 in the vertical direction. The second linear guide 48 illustrated in FIGS. 5 and 7 extends in the shape of an arc, on an accommodation for the linear guide in the form of a table 59, to implement pivoting ability of the workpiece contact surface 40 in the horizontal direction. A hydraulic cylinder 60 is provided as an actuator for pivoting the workpiece contact surface 40 in the horizontal direction, whereby a hydraulic cylinder, not shown, is also provided for pivoting the workpiece contact surface 40 in the vertical direction. The table 59 is mechanically coupled with the linear guide 48 that can be seen in FIG. 6, to implement pivoting ability of the workpiece contact surface 40 in the vertical direction.

The positioning means 46 comprise four feet 52, and the rack 42 is configured to be self-supporting or is self-supporting.

Figure 8:
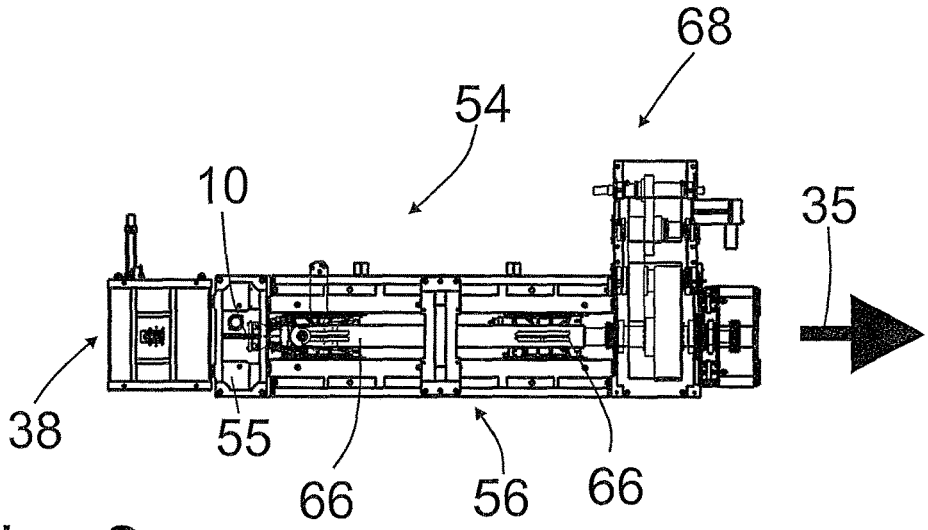
FIG. 8 a top view of a drawing system.
Figure 9:
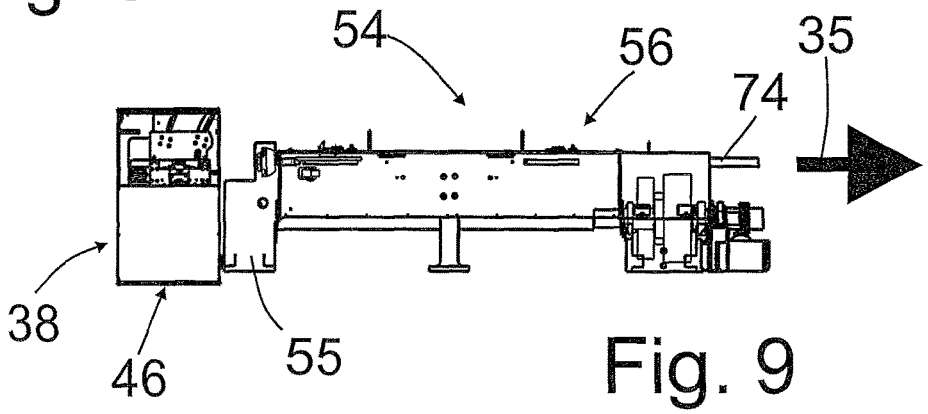
FIG. 9 a side view of the drawing system according to FIG. 8.

The drawing system 54 shown in FIGS. 8 to 10 comprises a drawing stand 55 that carries the drawing die arrangement 10, a drawing machine 56, and the workpiece guide 38 disposed ahead of the drawing die arrangement 10 in the drawing direction. In this connection, the drawing machine 56 draws a workpiece through the drawing die arrangement 10 in a guide tube 74 (see FIG. 10).

The drawing machine 56, as a two-carriage drawing machine, is provided with two drawing carriages 66. Alternatively, the drawing machine 56 can also be configured in the form of a caterpillar drawing machine or a drum drawing machine. In the departure region, the drawing machine 56 furthermore has a main gear mechanism 68 for the drive of the two carriages 66.

To implement effective displacement by means of the displacement device 44 of the workpiece guide 38, the latter must be disposed ahead of the drawing die arrangement 10 in such a manner that the center point of the above pivoting directions, about which the workpiece contact surface 40 can be pivoted in the horizontal and the vertical direction, is situated in the region of the drawing tool 14 (see FIG. 1) of the drawing die arrangement 10. However, the workpiece contact surface 40 does not necessarily have to be displaceable on a circular track, or the center point does not necessarily have to be situated in the region of the drawing tool 14, as long as the tolerances allow this.

REFERENCE SYMBOL LIST

10 drawing die arrangement
12 workpiece
14 drawing tool
16 drawing tool support
17 drawing ring
17A adapter ring
17B drawing ring holder
18 workpiece material
20 measurement device
22 coupling medium
24 circulation channel
26 accommodation opening for the measurement device
28 seal
30 spacer
31 projection
32 bracing apparatus
33 space for coupling medium
35 drawing direction
36 cylindrical region
38 workpiece guide
39 cable channel
39A cover
40 workpiece contact surface
42 rack
44 displacement device
46 means for positioning
48 linear guide
49 guide rail
50 fixation means
52 foot
54 drawing system
55 drawing stand
56 drawing machine
57 bracing element
58 three-point bracing unit
59 table
60 hydraulic cylinder
62 roll
64 tube
66 drawing carriage
68 main gear mechanism
70 hollow drawing area
72 drawing and wall ironing area
74 guide tube
75 pump
76 incoming and outgoing line
77 coupling medium supply

What is claimed is:

1. Workpiece guide for placement ahead of a drawing die arrangement, wherein the workpiece guide comprises:

a workpiece contact surface, a rack separate from the drawing die arrangement or from a drawing machine, the rack being self-supporting, a displacement device for the workpiece contact surface disposed on the rack, the displacement device comprising an accommodation and comprising first and second linear guides for the workpiece contact surface, the first linear guide extending in a shape of an arc in a vertical direction, the second linear guide extending in a shape of an arc on the accommodation and in a horizontal direction, the accommodation being in a form of a table, the displacement device being movable within the rack, and a rack positioner for positioning the rack with reference to the drawing die arrangement or the drawing machine, the rack positioner comprising a fixation device and at least a foot and/or an attachment device.

* * * * *